United States Patent [19]

Long

[11] 4,073,523

[45] Feb. 14, 1978

[54] CHAIN LOCK FOR SLIDING DOORS

[76] Inventor: Donald L. Long, 4806 NE. Winn Road, Apt. 6B, Kansas City North, Kans. 64119

[21] Appl. No.: 740,824

[22] Filed: Nov. 11, 1976

[51] Int. Cl.[2] ..... E05C 17/36

[52] U.S. Cl. ..... 292/264; 292/DIG. 46

[58] Field of Search ..... 292/264, 288, DIG. 46; 70/93

[56] References Cited

U.S. PATENT DOCUMENTS

| | | | |
|---|---|---|---|
| 206,383 | 7/1878 | Wright | 292/305 |
| 453,177 | 6/1891 | Chaplin | 292/305 |
| 3,920,273 | 11/1975 | Scholtze | 292/264 |
| 3,944,268 | 3/1976 | Gonzalez et al. | 292/264 |
| 3,975,041 | 8/1976 | Edison | 292/288 X |

*Primary Examiner*—Richard E. Moore

*Attorney, Agent, or Firm*—John A. Hamilton

[57] ABSTRACT

A chain lock for sliding doors which consist of two or more vertical panels horizontally relatively slidable in a frame either into essentially edge to edge relation to cover the frame, or into overlapping relation to open the door, only one of the panels being movable and the others fixed, the lock consisting of a short length of chain adapted to be extended horizontally between the slidable panel and either a fixed panel or the door frame, one end of the chain being securely affixed and the other end being detachably connected to permit movement of the slidable panel.

1 Claim, 6 Drawing Figures

CHAIN LOCK FOR SLIDING DOORS

Figures 1, 2, 3:
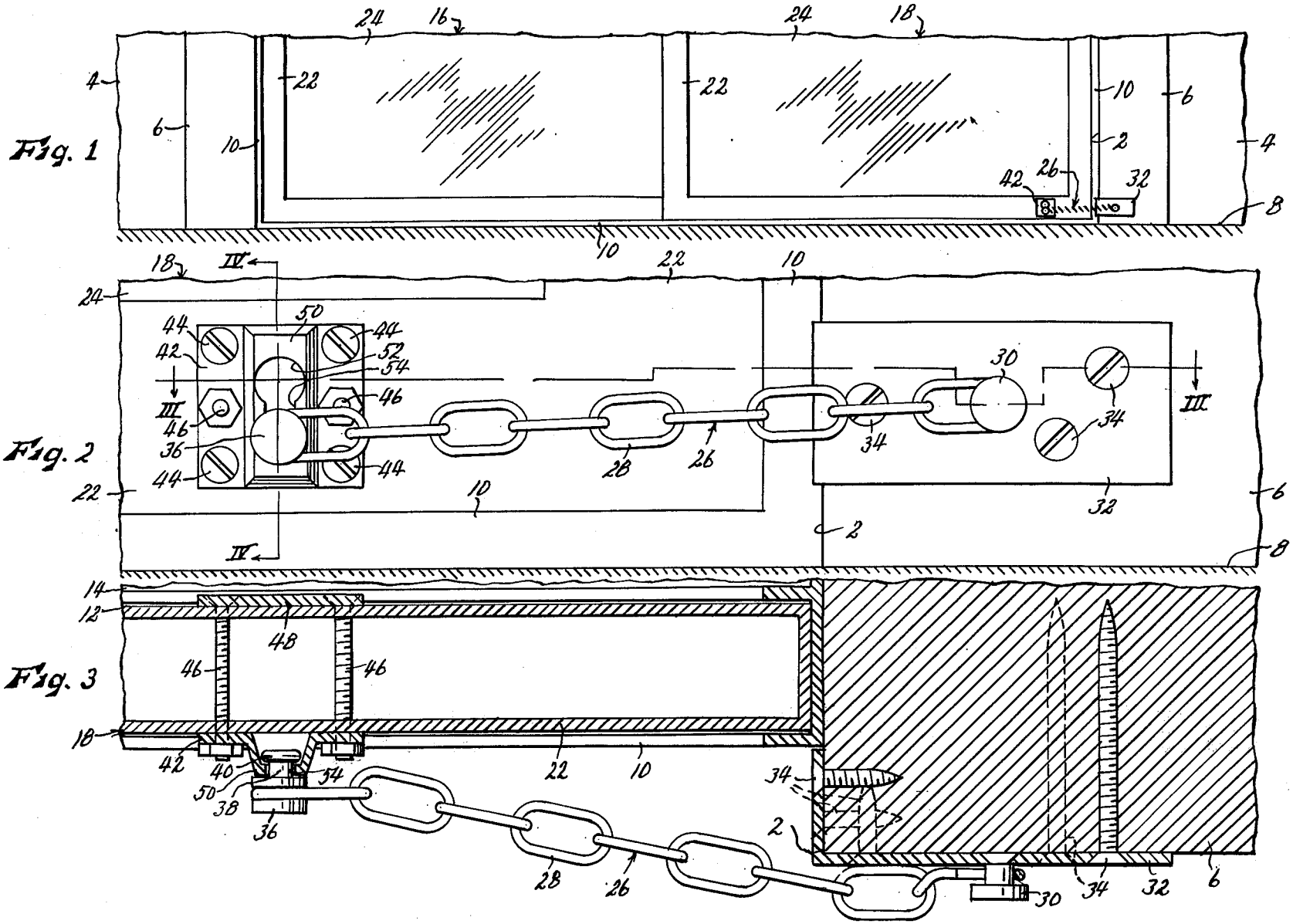

This invention relates to new and useful improvements in door locks, and has particular reference to locks of the "chain" type to be used in connection with doors of the "sliding" or "patio" type.

Sliding doors are of course widely used, especially for providing communication between the interiors of houses or other buildings and patios, balconies or the like disposed outside the buildings, but they are quite difficult to lock effectively, the locks commonly used being rather notoriously insecure.

Such doors usually consist of two or three vertical panels mounted in a channel shaped track bounding the door frame of the building, all of the panels but one being rigidly fixed in relation to the track, and the other panel being horizontally slidable in the track into parallel, overlapping relation with one of the fixed panels, whereby to open the door. Where the movable panel meets the door frame, or the edge of a fixed panel, as the door is closed, there is usually provided some kind of lock, sometimes key-operated but often lever operated, for securing the door closed. Usually this lock includes a hook-type latch lever pivoted in the panel and engageable with a keeper mounted in the door frame or in the adjacent fixed panel. However, the movable panel is virtually always mounted in the track with a certain amount of freedom for vertical movement, often being installed by lifting its upper edge into a relatively deep top channel of the track, then lowering its lower edge into a relatively shallower bottom channel of the track. Regardless of how it is installed, however, a certain amount of vertical play is necessary to preserve free movement of the panel in the event the upper and lower tracks are not precisely parallel, or should become nonparallel due to shifting or settling of the building. As a result, a screwdriver or the like can be forced into the lower track under the sliding panel, and the panel pried upwardly. This may even permit complete removal of the panel from the track, but in any event often permits the panel to be moved or shaken with enough force to break or release the usual latch-type lock. Attempts are often made to lock the door more securely by placing a length of board or other rigid strut between the edge of the sliding panel remote from the latch lock, and the distal edge of the door frame. This may be done so long as the sliding panel moves inside of the adjacent fixed panel, which is usually but not always the case. However, in sliding doors of this type there must always be some lateral operating clearance between the overlapping panels, and a wire or the like can be inserted through this clearance space to dislodge the board.

Accordingly, the object of the present invention is the provision of a lock for a door of the type described which solves all of the above described shortcomings and vulnerabilities of prior locks as described above, in that it is extremely strong, cannot be released or broken by vertical jostling or shaking of the slidable panel, and cannot be released by a wire or other slender object inserted through transverse clearance spaces between panels.

Generally, this object is accomplished by the provision of a lock consisting of a short length of linked chain extendable horizontally to bridge the juncture between the leading edge of the sliding door panel and the adjacent fixed panel or door frame, one end of the chain being permanently affixed to the fixed panel or door frame, and the other being detachably connected to the sliding panel.

Another object is the provision of a lock for sliding doors of the character described which need not be built into the doors during original manufacture of said doors, but may be sold as an add-on unit which may readily be applied to pre-existing doors.

Other objects are simplicity and economy of construction, ease and convenience of installation and use, and efficiency and dependability of operation.

Figure 5:
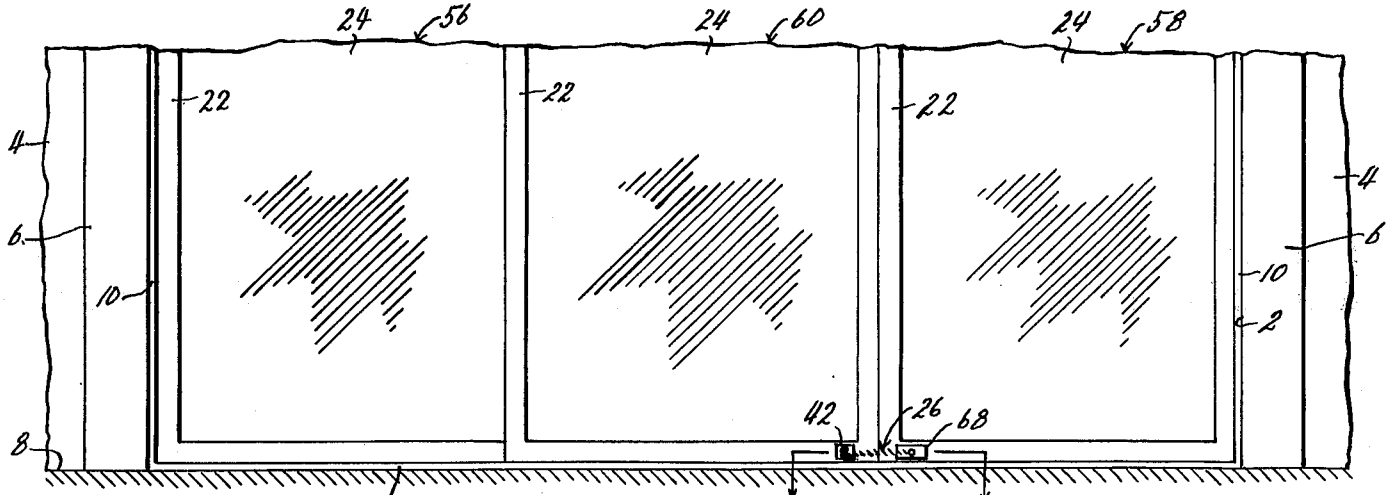
Figure 4:
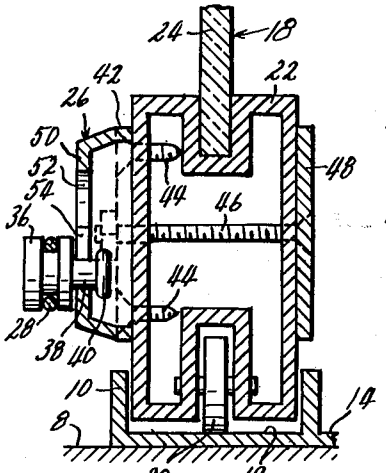
Figure 6:
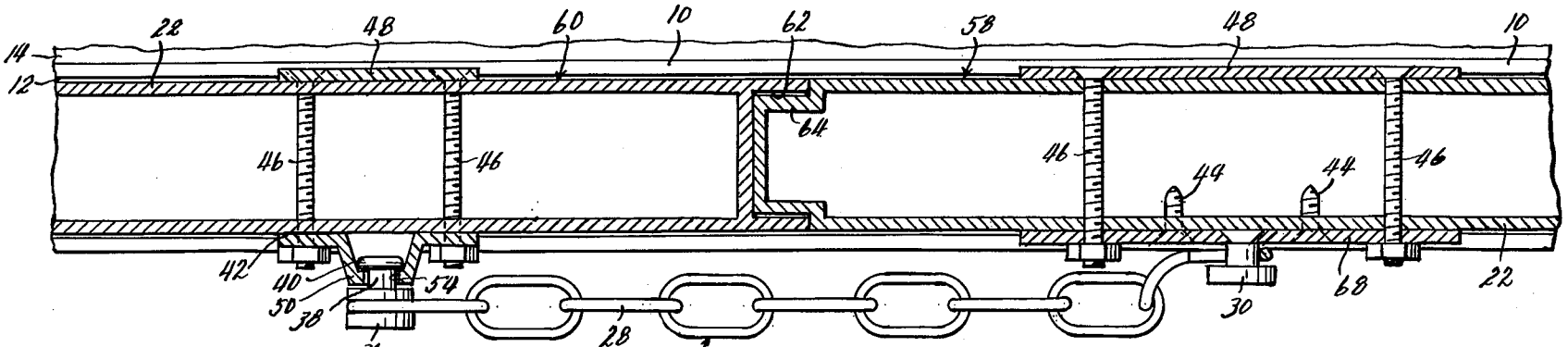

With these objects in view, as well as other objects which will appear in the course of the specification, reference will be had to the accompanying drawing, wherein:

FIG. 1 is a fragmentary, inside elevational view of the lower portion of a two-panel sliding door, shown in its closed position, and with a door lock embodying the present invention applied operatively thereto, FIG. 2 is a greatly enlarged view similar to FIG. 1 but showing only the lock and closely related elements of the door structure, FIG. 3 is a fragmentary sectional view taken on line III—III of FIG. 2, FIG. 4 is a fragmentary sectional view taken on line IV—IV of FIG. 2, FIG. 5 is a view similar to FIG. 1 but showing a three panel door, and FIG. 6 is a greatly enlarged fragmentary sectional view taken on line VI—VI of FIG. 5.

Like reference numerals apply to similar parts throughout the several views, and the numeral 2 applies to a rectangular door opening formed in the wall structure 4 of a building. Said door opening is provided with a door frame 6, only the lower portion thereof being shown. The room floor is indicated at 8. If a sliding door is to be installed the inner edge of the door frame has a track member 10 installed therein and completely bounding the top, bottom and side edges therof, and affixed in the door frame by any suitable means, not shown. The track member has the form of a double channel opening inwardly into the door opening, whereby to present side-by-side channel-shaped tracks 12 and 14, track 12 being the inner track nearest the interior of the room and track 14 being the outer track.

FIGS. 1 - 4 show a two-panel door, consisting of an outer panel 16 covering about one-half of the door opening, being mounted in outer track 14 and permanently affixed therein by any suitable means, not shown, and an inner panel 18 mounted in inner track 12 for horizontal sliding movement, or rolling movement if said panel is provided at its lower edge with rollers 20, as shown in FIG. 4. Each panel ordinarily consists of a metal frame 22 in which glass pane 24 is mounted, the frame 22 engaging in track member 10. As shown, fixed panel 16 is the left panel, engaging in the left vertical portion of track member 10, while slidable panel 18 is the right panel, its right vertical edge, when it is closed, engaging in the right upright portion of track member 10. The "telescoping" of the right edge of panel 18 into track 10, when it is closed, is important to the present invention, as will appear.

The door lock contemplated by the present invention is indicated generally by the numeral 26, and includes a short length of linked chain 28 adapted to span horizontally the juncture between the right edge of panel 18 and the right side of door frame 6, when said panel is closed, preferably at the bottom of the door, as shown. One end of said chain is secured permanently to a button 30 riveted in a mounting plate 32. Said mounting plate is of right-angled form and embraces the inside corner of door frame 6, being permanently affixed to said door frame by screws 34 extending through both legs of said plate. Said screws may be of any number and length required to insure the desired high security of mounting of the plate, and the use of angularly related screws through both legs of the plate further contributes to this security. Of course, these screws presuppose a wooden door frame. If the door frame should be metal, metal screws, bolts or even welding could be used to attach mounting plate 32.

The opposite end of chain 28 has permanently affixed thereto a button 36 including a neck 38 projecting laterally of the chain and having an enlarged head 40. A plate 42 is affixed to the inner surface of the bottom member of the metal frame 22 of door panel 18 with great security, such as by metal screws 44, and/or by bolts 46 extending through the panel frame and based in a back-up plate 48 disposed at the outer side of said panel frame. Plate 42 has a portion 50 thereof offset away from the inner side of the panel frame, in which is formed a keyhole slot the upper portion 52 of which is large enough to admit head 40 of button 36, and the lower portion 54 of which is too narrow to pass head 40, but wide enough to admit neck 38 of the button. Thus button 36 may be engaged in plate 42 by first inserting head 40 through slot portion 52, then lowering said button to engage its neck in slot portion 54, and disengaged from the plate by reversing the process. The button is biased to its engaged position by gravity.

In operation, the lock is engaged by inserting button 36 in slot 52 – 54 when th door is closed, and disengaged by removing the button from the slot. Its use is therefore very simple, yet it provides a degree of security unobtainable by the use of prior locks for sliding doors. Prying the movable door panel upwardly and shaking or moving it violently, a process often used by thieves to open locked sliding doors, has no effect on the present lock. It is important, of course, that when the lock is installed, the mounting plates 32 and 42 be installed so that chain buttons 30 and 36 are so spaced that when the door is closed and the chain is engaged, said chain will have little or no slack. This prevents the opening of panel 18 sufficiently to provide a gap between said panel and the door frame through which bolt cutters could be inserted to cut the chain. If the door panel 18, when closed, telescopes within track channel 10, as shown and as is usually the case, then chain 28, when engaged, may easily be set to have too small a degree of slack to permit the panel even to be withdrawn completely from the track channel. This further prevents the insertion of even a wire or other slender member between the door panel and door frame for the prupose of engaging the chain to raise it and disengage button 36 from slot 52 – 54. The lock as shown is of course readily applicable to virtually any pre-existing sliding door. The chain is preferably permanently affixed to the door frame rather than panel 18, in order that said panel, when opened, will not be required to drag the chain.

FIGS. 5 and 6 show the door lock applied to a three-panel sliding door including a left panel 56 permanently affixed in outer track 14, a right panel 58 permanently affixed in inner track 12, and a central panel 60 slidably engaged in inner track 12, so that when it is moved to the right to close it, its right edge engages the left edge of panel 58, the engaging edges being formed to present a telescopingly engaging groove 62 and tongue 64, as shown in FIG. 6. The lock chain 28 of lock 26 is positioned to bridge the juncture between panels 58 and 60. Slotted plate 42 for engaging chain button 36 is mounted on panel 60 in a manner identical to that shown in FIGS. 1 – 4. Chain button 30 is affixed in a mounting plate 68 which is affixed to panel 58 in the same manner as plate 42, as by bolts 46, back-up plate 48, and metal screws 44. While I have shown the lock applied to doors opening to the left, with the sliding panel inside of the adjacent fixed panel which it overlaps as it is opened, it will be readily apparent that the present lock is also usable on doors opening to the right, or in which the sliding panel is outside the adjacent fixed panel. When the sliding panel is outside the fixed panel, however, the outward offset 50 of plate 42 will engage and abut an edge of the fixed panel as the sliding panel is opened. This limits the opening of the sliding panel to some degree, but not to a degree rendering use of the lock on such doors impractical.

While I have shown and described certain specific embodiments of my invention, it will be readily apparent that many minor changes of structure and operation could be made without departing from the spirit of the invention.

What I claim as new and desire to protect by Letters Patent is:

1. In combination with a sliding door including a vertical, generally planar panel horizontally movable in its own plane in a door frame, a vertical edge of said panel being movable into telescoping engagement with a channel member forming an element of said door frame to close said door, a door lock comprising:

a. a strong linked chain adapted to be extended generally horizontally and parallel to the plane of said panel to bridge the juncture of said panel and said frame channel when said panel and channel are in telescoped relation, and b. means operable to secure the opposite ends of said chain to said panel and to said door frame, the means connecting one of said chain ends to said door frame constituting a right angled plate to which said chain is permanently connected and which embraces a vertical corner of said door frame, and screw-type fasteners securing both of the right-angled plate legs to said door frame, whereby the fasteners associated with the respective plate legs are disposed at right angles to each other; and the means connecting the other of said chain ends to said panel constituting a button affixed to said other chain end and including a neck projecting therefrom laterally of the general extent of said chain and having an enlarged head at its extended end, and a plate affixed to said panel, said plate having a vertical slot formed therethrough, the upper end portion of said slot being large enough to admit said head, and the lower end portion of said slot being of reduced size so as to pass said neck but not said head therethrough, the end connections of said chain to said panel and said door frame being so spaced, relative to the length of said chain, that said panel cannot be moved out of its telescoped engagement with said channel when said chain is connected to said panel.

* * * * *